US009640952B2

(12) United States Patent
Camilli

(10) Patent No.: US 9,640,952 B2
(45) Date of Patent: May 2, 2017

(54) HIGH POWER SEMI-SURFACE GAP PLUG

(71) Applicant: Enerpulse, Inc., Albuquerque, NM (US)

(72) Inventor: Louis S. Camilli, Albuquerque, NM (US)

(73) Assignee: ENERPULSE, INC., Albuquerque, NM (US)

( * ) Notice: Subject to any disclaimer, the term of this patent is extended or adjusted under 35 U.S.C. 154(b) by 1118 days.

(21) Appl. No.: 13/752,019

(22) Filed: Jan. 28, 2013

(65) Prior Publication Data

US 2013/0196272 A1 Aug. 1, 2013

Related U.S. Application Data

(60) Provisional application No. 61/591,567, filed on Jan. 27, 2012.

(51) Int. Cl.

| | |
|---|---|
| ***H01T 13/20*** | (2006.01) |
| ***H01T 13/40*** | (2006.01) |
| ***F23Q 3/00*** | (2006.01) |
| ***H01T 13/46*** | (2006.01) |
| ***H01T 13/08*** | (2006.01) |
| ***H01T 13/52*** | (2006.01) |
| ***H01T 21/02*** | (2006.01) |
| *H01T 13/00* | (2006.01) |

(52) U.S. Cl.

CPC ..... *H01T 13/20* (2013.01); *F23Q 3/006* (2013.01); *H01T 13/08* (2013.01); *H01T 13/40* (2013.01); *H01T 13/467* (2013.01); *H01T 13/52* (2013.01); *H01T 21/02* (2013.01)

(58) Field of Classification Search

CPC . F02P 3/06; H01T 13/00; H01T 13/20; H01T 13/41; H01T 13/52; H01T 21/02

USPC ..... 123/146.5 R, 596, 605, 620, 169 R; 313/141, 135, 142, 143

See application file for complete search history.

(56) References Cited

U.S. PATENT DOCUMENTS

| | | | | |
|---|---|---|---|---|
| 1,148,106 A | | 7/1915 | Lux | |
| 2,360,287 A | | 10/1944 | Smith | |
| 2,391,456 A | * | 12/1945 | Hensel | H01T 13/39 313/11.5 |
| 2,391,458 A | | 12/1945 | Hensel | |
| 2,449,403 A | | 9/1948 | McDougal | |
| 2,908,569 A | | 10/1959 | PerasLucien | |
| 3,267,325 A | | 8/1966 | Why | |
| 3,581,141 A | | 5/1971 | Beaubier | |
| 3,599,030 A | | 8/1971 | Armstrong | |
| 3,603,835 A | | 9/1971 | Eaton | |
| 3,668,749 A | | 6/1972 | Podiak et al. | |

(Continued)

FOREIGN PATENT DOCUMENTS

| | | |
|---|---|---|
| CN | 1150348 | 5/1997 |
| CN | 1254972 | 5/2000 |

(Continued)

*Primary Examiner* — Mahmoud Gimie

(74) *Attorney, Agent, or Firm* — Justin R. Jackson; Jeffrey D. Myers; Peacock Myers, P.C.

(57) ABSTRACT

A spark plug having a capacitor formed therein and a semi-surface gap, wherein the capacitor permits a high-impulse discharge to occur across the semi-surface gap and the pronounced effects of the Lorentz force, due to the high voltage and high current discharge, cause the spark to project axially away from the end of the spark plug.

19 Claims, 11 Drawing Sheets

(56) References Cited

U.S. PATENT DOCUMENTS

| | | | | |
|---|---|---|---|---|
| 3,683,232 | A | 8/1972 | Baur | |
| 3,790,842 | A | 2/1974 | Westenkirchner et al. | |
| 3,831,562 | A | 8/1974 | Paxton et al. | |
| 3,868,530 | A | 2/1975 | Eaton et al. | |
| 4,078,534 | A | 3/1978 | Mayer | |
| 4,082,976 | A | 4/1978 | Lentz | |
| 4,093,887 | A | 6/1978 | Corbach et al. | |
| 4,419,539 | A | 12/1983 | Arrigoni | |
| 4,446,058 | A | 5/1984 | Sakai et al. | |
| 4,460,847 | A | 7/1984 | Englehardt | |
| 4,549,114 | A | 10/1985 | Herden | |
| 4,568,855 | A | 2/1986 | Nemeth et al. | |
| 4,613,789 | A | 9/1986 | Herden et al. | |
| 4,746,834 | A | 5/1988 | Bauerle et al. | |
| 4,751,430 | A | 6/1988 | Muller et al. | |
| 4,771,209 | A * | 9/1988 | Ryan | H01T 13/52 313/140 |
| 4,841,925 | A | 6/1989 | Ward | |
| 4,914,344 | A | 4/1990 | Watanabe et al. | |
| 4,952,837 | A | 8/1990 | Matsumura et al. | |
| 5,028,747 | A | 7/1991 | Ballentine et al. | |
| 5,049,786 | A | 9/1991 | Gotisar et al. | |
| 5,095,242 | A * | 3/1992 | Richeson | H01T 13/41 313/136 |
| 5,187,404 | A | 2/1993 | Straub | |
| 5,210,458 | A | 5/1993 | McDougal | |
| 5,272,415 | A | 12/1993 | Griswold et al. | |
| 5,304,894 | A | 4/1994 | Stimson | |
| 5,371,436 | A | 12/1994 | Griswold et al. | |
| 5,391,100 | A | 2/1995 | Maruyama et al. | |
| 5,514,314 | A | 5/1996 | McDougal | |
| 5,514,929 | A | 5/1996 | Kawamura | |
| 5,751,096 | A | 5/1998 | Lahens | |
| 5,866,972 | A | 2/1999 | Matsubara et al. | |
| 6,060,821 | A | 5/2000 | Suzuki et al. | |
| 6,095,124 | A | 8/2000 | Matsubara et al. | |
| 6,130,498 | A | 10/2000 | Shimizu et al. | |
| 6,132,277 | A | 10/2000 | Tribble et al. | |
| 6,208,066 | B1 | 3/2001 | Kokubu et al. | |
| 6,329,743 | B1 | 12/2001 | Camilli | |
| 6,341,501 | B2 | 1/2002 | Sugimoto et al. | |
| 6,517,931 | B1 | 2/2003 | Fu | |
| 6,533,629 | B1 | 3/2003 | Boehler et al. | |
| 6,559,578 | B1 | 5/2003 | Herden et al. | |
| 6,647,794 | B1 | 11/2003 | Nelson et al. | |
| 6,771,009 | B2 | 8/2004 | Nishikawa et al. | |
| 6,798,125 | B2 | 9/2004 | Sugiyama et al. | |
| 6,819,030 | B2 | 11/2004 | Lipp et al. | |
| 6,864,623 | B2 | 3/2005 | Ishikawa | |
| 7,007,653 | B2 | 3/2006 | Labarge et al. | |
| 7,019,448 | B2 | 3/2006 | McMurray et al. | |
| 8,049,399 | B2 | 11/2011 | Camilli | |
| 8,278,808 | B2 | 10/2012 | Lykowski | |
| 8,672,721 | B2 | 3/2014 | Camilli | |
| 2001/0040089 | A1 | 11/2001 | Hemingway et al. | |
| 2002/0115549 | A1 | 8/2002 | Geier et al. | |
| 2002/0130603 | A1 | 9/2002 | Teramura et al. | |
| 2004/0239223 | A1 | 12/2004 | Watanabe | |
| 2005/0093413 | A1 | 5/2005 | Downs et al. | |
| 2005/0110382 | A1 | 5/2005 | Walker, Jr. | |
| 2005/0168121 | A1 | 8/2005 | Tinwell | |
| 2006/0028106 | A1 | 2/2006 | Lineton et al. | |
| 2006/0220510 | A1 | 10/2006 | Shibata | |
| 2007/0116976 | A1 | 5/2007 | Tan et al. | |
| 2007/0159047 | A1 | 7/2007 | Ishinada | |
| 2007/0188063 | A1 | 8/2007 | Lykowski | |
| 2007/0188064 | A1* | 8/2007 | Lykowski | H01T 13/20 313/141 |
| 2007/0262721 | A1* | 11/2007 | Camilli | H01T 13/40 315/32 |
| 2008/0018216 | A1* | 1/2008 | Camilli | F02P 3/08 313/141 |
| 2011/0037371 | A1* | 2/2011 | Kuribayashi | H01T 13/36 313/134 |
| 2012/0142243 | A1 | 6/2012 | Camilli | |
| 2013/0065474 | A1* | 3/2013 | Lykowski | H01T 13/38 445/7 |
| 2015/0111458 | A1 | 4/2015 | Camilli | |

FOREIGN PATENT DOCUMENTS

| | | | |
|---|---|---|---|
| CN | 2398751 | Y | 9/2000 |
| CN | 2583845 | | 10/2003 |
| DE | 102004018272 | A1 | 11/2004 |
| EP | 0118789 | | 2/1984 |
| EP | 0287080 | | 10/1988 |
| EP | 0302474 | | 2/1989 |
| EP | 1 320 159 | A1 | 6/2003 |
| EP | 1 701 419 | A1 | 9/2006 |
| GB | 937646 | | 9/1963 |
| GB | 2 361 264 | | 10/2001 |
| JO | 2001-335360 | | 12/2001 |
| JP | 53-127942 | | 11/1978 |
| JP | 56-88280 | | 7/1981 |
| JP | 61-258970 | | 11/1986 |
| JP | 62-503134 | | 12/1987 |
| JP | 1987-503134 | | 12/1987 |
| JP | 04-133281 | | 5/1992 |
| JP | 07-037673 | | 2/1995 |
| JP | 10-022050 | | 1/1998 |
| JP | 11-185929 | | 7/1999 |
| JP | 2000-046628 | | 2/2000 |
| JP | 2000-252039 | | 9/2000 |
| JP | 2003-187944 | | 7/2003 |
| JP | 2004-319335 | | 11/2004 |
| JP | 2007-512662 | | 5/2007 |
| JP | 2008021643 | | 1/2008 |
| JP | 2009-527078 | | 7/2009 |
| JP | 2009-193737 | | 8/2009 |
| JP | 2009-545105 | | 12/2009 |
| JP | 2010-212245 | | 9/2010 |
| WO | 2008011591 | A2 | 1/2008 |

* cited by examiner

NGK BKR9EIX Spark Plug
4.06 KΩ Resistance
1.1 pF capacitance

NGK BKR9EIX Spark Plug
4.06 KΩ Resistance
1.1 pF capacitance

Pulstar be1c Pulse Plug
5.15 KΩ Resistance
28.7 pF capacitance

Pulstar be1c Pulse Plug
5.15 KΩ Resistance
28.7 pF capacitance

HIGH POWER SEMI-SURFACE GAP PLUG

CROSS-REFERENCE TO RELATED APPLICATIONS

This application claims priority to and the benefit of the filing of U.S. Provisional Patent Application Ser. No. 61/591,567, entitled "Surface Gap Pulsed Spark plug", to Louis S. Camilli, filed on Jan. 27, 2012, and the specification thereof is incorporated herein by reference.

BACKGROUND OF THE INVENTION

Field of the Invention (Technical Field)

Embodiments of the present invention relate to spark plugs wherein a portion of the spark gap comprises a surface gap and a portion comprise an air gap, thus forming a semi-surface gap. Embodiments of the present invention further comprise a semi-surface spark plug having a capacitor incorporated therein, thereby increasing the electrical current and thus the power of the spark during the streamer phase of the spark event and inducing the spark to project axially away from the spark plug and into an engine cylinder due to the Lorentz force. The additional increase in spark power creates a much larger flame kernel than is encountered in traditional spark plugs, thereby improving fuel ignition, enhancing completeness of fuel burn, and thus increasing the power output and fuel efficiency of the engine beyond that of a traditional spark plug.

Description of Related Art

While typical spark plug technology dates back to the early 1950's, recently there have been many attempts at creating higher capacitance in the spark plug or attaching a capacitor in parallel to existing spark plugs. Although these designs increase the discharge power of the spark, known designs are either inefficient or are complex and expensive. The present invention provides a simple and reliable method and apparatus whereby a capacitor is incorporated into a spark plug having a semi-surface gap.

U.S. Pat. No. 3,683,232; U.S. Pat. No. 1,148,106; and U.S. Pat. No. 4,751,430 discuss employing a capacitor or condenser to increase spark power. There is no disclosure as to the electrical size of the capacitor, which would determine the power of the discharge. Additionally, if the capacitor is of large enough capacitance, the voltage drop between the ignition transformer output and the spark gap could prevent gap ionization and spark creation.

U.S. Pat. No. 3,599,030 to Armstrong describes a surface-gap spark plug operating with an engine employing a capacitor discharge ignition system. Armstrong teaches that by using a surface gap design, coupled with a high tension, rapid-rise time discharge system, substantially all plug-maintenance issues can thus be avoided. Armstrong, however, fails to teach the use of a semi-surface plug or how to incorporate a capacitor into a plug, much less a capacitor which is automatically triggered. Because electrical resistance is lower across a surface than it is through an air-gap and because Armstrong merely teaches a surface-gap plug, the maximum voltage that Armstrong can create before its arc is initiated is thus much lower than that which would be possible if Armstrong formed all or at least a portion of the spark gap from an air gap. In addition, because the surface of the insulator which Armstrong uses acts as a heat sink to draw heat away from the arcing terminals, Armstrong is thus left to deal with carbon build ups on its outer electrode. Still further, because Armstrong's entire spark gap is formed from the surface of the insulator and because the breakdown voltage is thus much lower than what would be experienced if an air gap were used, the total peak voltage and current of the spark of Armstrong's plug is thus also lower. Because of the lower voltage and current, any resulting Lorentz force that Armstrong may experience is not sufficient to lift the spark off of the surface of the insulator and project it away from the spark plug and thus into the air/fuel mixture.

U.S. Pat. No. 4,549,114 claims to increase the energy of the main spark gap by incorporating into the body of the spark plug an auxiliary gap. The use of two spark gaps in a singular spark plug to ignite fuel in any internal combustion spark ignited engine that utilizes electronic processing to control fuel delivery and spark timing could prove fatal to the operation of the engine as the EMI/RFI emitted by the two spark gaps could cause the central processing unit to malfunction.

In U.S. Pat. No. 5,272,415, a capacitor is disclosed attached to a non-resistor spark plug. Capacitance is not disclosed and nowhere is there any mention of the electromagnetic and radio frequency interference created by the non-resistor spark plug, which if not properly shielded against EMI/RFI emissions, could cause the central processing unit to shut down or even cause permanent damage.

U.S. Pat. No. 5,514,314 discloses an increase in size of the spark by implementing a magnetic field in the area of the positive and negative electrodes of the spark plug. The invention also claims to create monolithic electrodes, integrated coils and capacitors but does not disclose the resistivity values of the monolithic conductive paths creating the various electrical components. Electrical components conductive paths are designed for resistivity values of 1.5-1.9 ohms/meter ensuring proper function. Any degradation of the paths by migration of the ceramic material inherent in the cermet ink reduces the efficacy and operation of the electrical device. In addition, there is also no mention of the voltage hold-off of the insulating medium separating oppositely charged conductive paths of the monolithic components. If standard ceramic material such as Alumina 86% is used for the spark plug insulating body, the dielectric strength, or voltage hold off is 200 volts/mil. The standard operating voltage spread for spark plugs in internal combustion spark ignited engines is from 5 Kv to 20 Kv with peaks of 40 Kv seen in late model automotive ignitions, which might not insulate the monolithic electrodes, integrated coils and capacitors against this level of voltage.

Although some conventional semi-surface gap plugs are known, such plugs have enjoyed only very limited use in internal combustion engines where a relatively constant engine speed is maintained. This is because semi-surface gap plugs are highly susceptible to fouling, which occurs in engines that encounter dynamic engine speeds. Because most engines, especially those in automobiles, routinely operate across a wide spectrum of engine speeds, known semi-surface gap plugs have been unable to provide desirable results and thus be adopted for use in such engines. One benefit of a pulsed semi-surface gap plug is that higher peak voltages are achievable over conventional plugs, thus imparting more ignition energy to the air/fuel mixture and thus increasing engine performance. There is therefore a present need for a semi-surface gap plug which can be used in dynamic speed engines.

BRIEF SUMMARY OF EMBODIMENTS OF THE PRESENT INVENTION

In operation, the ignition pulse is exposed to the spark gap and the capacitor simultaneously as the capacitor is connected in parallel to the circuit. As the coil rises inductively in voltage to overcome the resistance in the spark gap, energy is stored in the capacitor as the resistance in the capacitor is less than the resistance in the spark gap. Once resistance is overcome in the spark gap through ionization, there is a reversal in resistance between the spark gap and the capacitor, which triggers the capacitor to discharge the stored energy very quickly, typically between about 1-10 nanoseconds, across the spark gap, peaking the current and therefore the peak power of the spark.

Preferably, the capacitor charges to the voltage level required to breakdown the spark gap. As engine load increases, vacuum decreases, increasing the air pressure at the spark gap. As pressure increases, the voltage required to break down the spark increases, causing the capacitor to charge to a higher voltage. The resulting discharge is peaked to a higher power value. Preferably, there is no delay in the timing event as the capacitor is charging simultaneously with the rise in voltage of the coil. The resulting higher-powered spark that is produced at the semi-surface gap of the plug projects axially away from the surface of insulator at the spark gap and thus further into the engine cylinder than is reached by the tip of the spark plug.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

An embodiment of the present invention relates to a spark plug having a central electrode, a solid insulator at least substantially concentrically surrounding the central electrode at a terminal end portion thereof, an air gap at least substantially concentrically surrounding the solid insulator at a terminal end portion thereof, an outer electrode at least substantially concentrically surrounding the air gap, wherein a spark gap is formed between the central electrode and the outer electrode and includes that air gap and a surface of the insulator, and a capacitor formed into the spark plug. In one embodiment, the outer electrode can have one or more protuberances which can be disposed on a terminal end portion thereof. Optionally, there can be more than three protuberances and optionally there can be more than five protuberances.

In one embodiment, an outer plate of the capacitor is electrically connected to the outer electrode the solid insulator forms a dielectric of the capacitor. Optionally, the capacitor comprises two plates and at least one of the plates is formed from a conductive ink. The central electrode can be electrically connected to a plate of the capacitor.

In one embodiment, no portion of the outer electrode extends to intersect a path which is axially aligned with a primary axis of the center electrode. Optionally, the spark plug can also have an electrical resistor communicably coupled to a plate of the capacitor. And, the resistor can be electrically connected such that it resists the flow of electricity during charging of the capacitor, but does not resist the flow of electricity from the capacitor to the spark gap.

An embodiment of the present invention also relates to a spark plug having a capacitor formed in the spark plug, a spark gap formed on a terminal end portion of the spark plug, the spark gap including an air gap and a surface of a solid insulator, and wherein a terminal end portion of an outer conductor of the spark plug does not project radially inward toward an inner conductor of the spark plug. In one embodiment, the dielectric, the insulator, and the solid insulator are all connected and are all formed from a single piece of material.

An embodiment of the present invention also relates to a method for igniting fuel which includes forming a capacitor into a spark plug; forming a semi-surface spark gap such that sparks formed during operation of the spark plug extend radially between an inner conductor and an outer conductor and travel across a surface of a solid insulator and travel across an air gap; and projecting sparks formed during operation of the spark plug axially away from an end portion of the spark plug due to the effects of a force acting on the electron streams forming the sparks. In one embodiment, the force can include the Lorentz force.

In one embodiment, projecting sparks can include projecting sparks axially away from an end portion of the spark plug by a distance having a magnitude of at least ½ of a closest distance between the inner conductor and the outer conductor; and more preferably by a distance having a magnitude which is at least equal to that of a closest distance between the inner conductor and the outer conductor.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

An embodiment of the present invention preferably relates to an improved spark plug having a spark gap formed from an air gap and a surface gap and wherein the spark plug has a capacitor formed therein.

As used throughout this application, the term "resistor" is intended to include any material having a resistivity of at least 10 Ohms per cm.

Figure 7B:
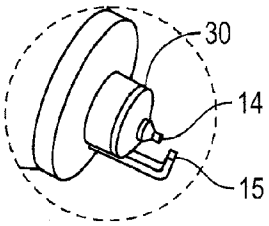
FIGS. 7A-D are drawings which illustrate a cut-away perspective view of a spark plug as well as multiple end configurations according to embodiments of the present invention.
Figure 7C:
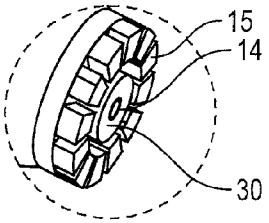
Figure 7D:
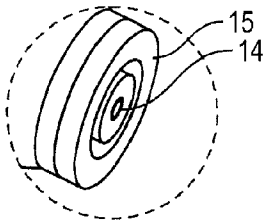
Figure 7A:
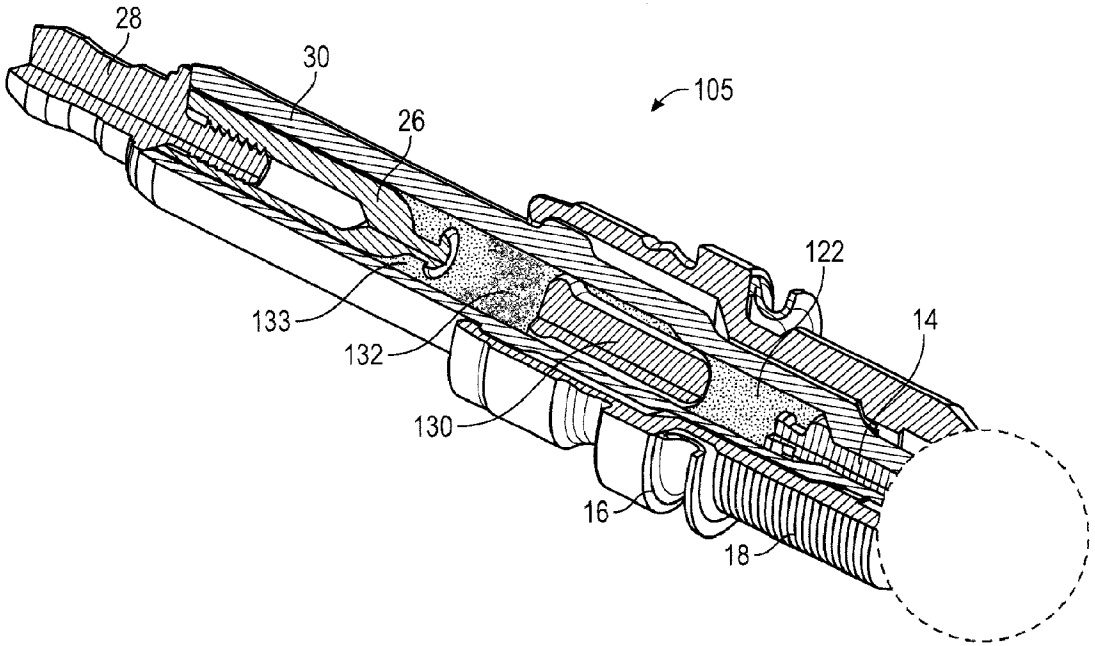

As illustrated in FIGS. 1-4B, plug 10 preferably comprises surface spark gap 11, which is preferably formed from open air portion 12 and an end surface of insulator 30, which preferably reside between inner conductor 14 and negative electrode 15. In one embodiment, open air portion 12 is preferably formed from a recessed area that is disposed between insulator 30, at spark gap 11, and negative electrode 15. Optionally, negative electrode 15 can simply be an end portion of outer conductor 16, or electrode 15 can be formed from a separate material which is electrically connected to outer conductor 16. For example, negative electrode 15 can be formed from a noble metal alloy to reduce erosion, which can be welded or otherwise attached to or formed onto outer conductor 16. Outer conductor 16 preferably makes contact with an engine circuit through threaded portion 18 being screwed into a grounded engine block. In one embodiment, inner conductor 14 preferably includes resistor connection material 22 and 22', resistor 24, conductor 26 and connection post 28. In this embodiment, the capacitor can be formed by insulator 30, conductive coating 32, and a portion of resistor 24. Because in this embodiment, the resistivity thus determines the efficiency of the capacitor, the performance of the capacitor can optionally be adjusted by forming more or less of the inner plate from resistor 24 and/or by adjusting the resistivity value of the resistor. Optionally, connection material 22 and 22' are preferably formed from a conductive frit material, which most preferably comprises a copper material. In another embodiment, as best illustrated in FIG. 7A, no portion of the resistor is used to form a plate of the capacitor. Instead, conductive coatings 32 and 33, as best illustrated in FIGS. 4A and B, are preferably used as the conductive plates of the capacitor. In an alternative embodiment, an inner plate of the capacitor can be formed those portions of conductive frit 122, and gas seal insert 130 which are nearest insulator 30 in lieu of all or a portion of conductive coating 33. In yet another embodiment, all or a portion of conductive coating 32 can be omitted in lieu of that portion of outer conductor 16, which is nearest insulator 30. In FIGS. 4A and B, a surface of insulator 30 is cross-hatched to indicate a preferred application area of conductive coatings 32 and 33. Connection to conductive coating 32 is preferably made to outer conductor 16 via conductive seal 34. Not only does conductive seal 34 provide electrical connection between the capacitor plate formed by conductive coating 32, and outer conductor 16, but it also prevents heated gases from passing between insulator 30 and outer conductor 16 while in use in an engine. While conductive seal 34 can be made from numerous materials and will provide desirable results, seal 34 most preferably comprises a copper material.

The outer plate of the capacitor is preferably formed by conductive coating 32 disposed thereon. Optionally, coating 32 can comprise a conductive ink and coating 32 can optionally be disposed on an outside portion of insulator 30 via spraying, pad printing, rolling, dipping, brushing, or another application method. In one embodiment, a portion of an outside diameter of insulator 30 is covered except for a predetermined distance, such as for example about 12.5 mm of the end of insulator 30 where post 28 is disposed, as well as that portion of the insulator exposed in the combustion chamber. Optionally, conductive coating 32 comprises silver or a silver/platinum alloy.

In one embodiment, once conductive coating 32 is applied to insulator 30, it is subjected to a temperature of between about 750° to about 900° C. by infrared, natural gas, propane, electric or other heat source capable of delivering reliable and controllable heat. Insulator 30 is preferably exposed to the heat for a period of about 10 minutes to over about 60 minutes, depending on the formula of conductive coatings 32 and/or 33. This evaporates the solvents and carriers and preferably molecularly bonds the metals to the surface of insulator 30. Once the coatings 32 and/or 33 are bonded to insulator 30, the resistivity of the plates is identical to or substantially the same as the resistivity of the pure metal.

Insulator 30 is preferably constructed of any alumina, other ceramic derivation, or another material which is resistant to electricity and which provides adequate structural qualities to provide plug 10 with the ability to achieve desirable results, so long as the dielectric strength of the material is sufficient to insulate against the voltages of an internal combustion ignition. In one embodiment, the outer plate of the capacitor is bonded to the outside surface of insulator 30, and the inner plate is formed from a conductive plate bonded to at least a portion of the inner surface of insulator 30, the capacitance is calculated using a formula that includes the surface area of those opposing surfaces of insulator 30, as well as its dielectric constant and its thickness. Capacitance values of the capacitor can vary from about 10 picofarads to as much as 100 picofarads dependent on the geometry of the plates, and the thickness and dielectric constant of insulator 30.

Figure 1:
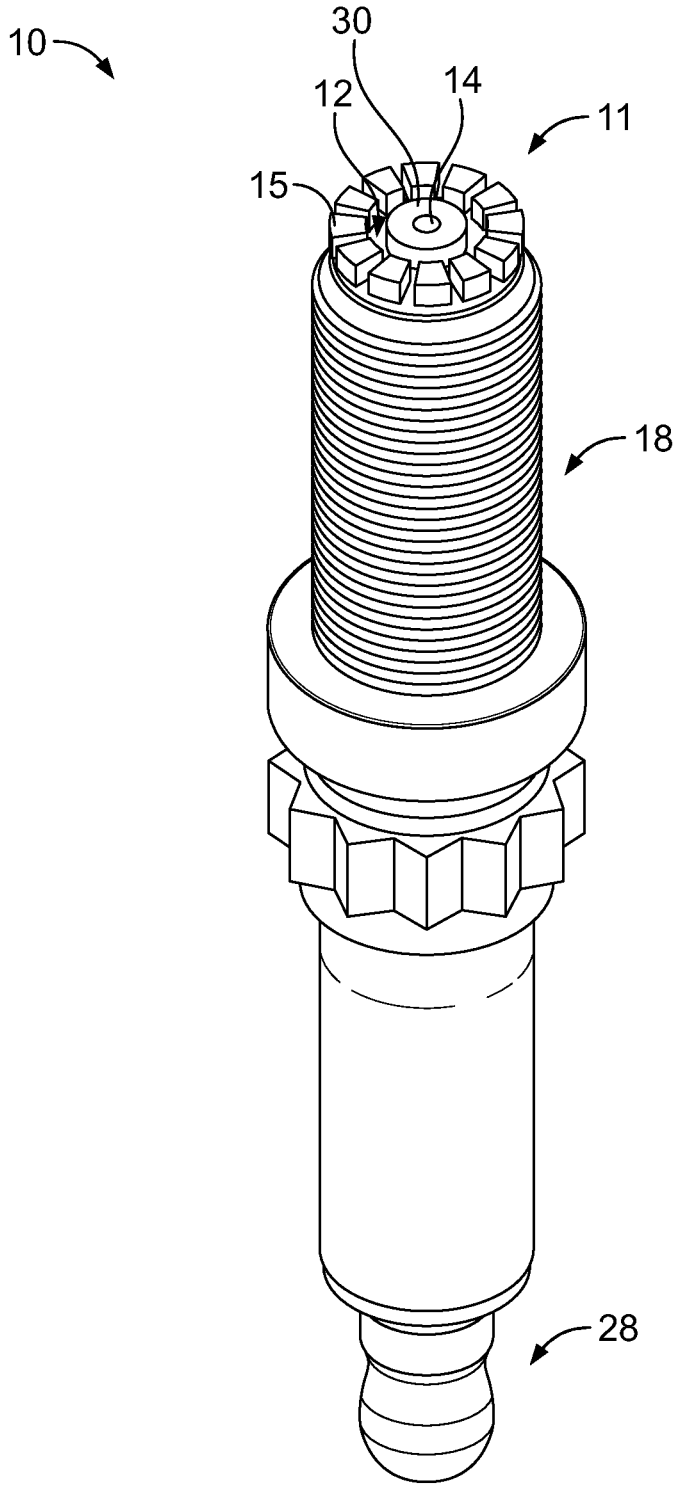
FIG. 1 is drawing which illustrates a surface-gap spark plug according to an embodiment of the present invention having a crown-shaped negative electrode.
Figure 2A:
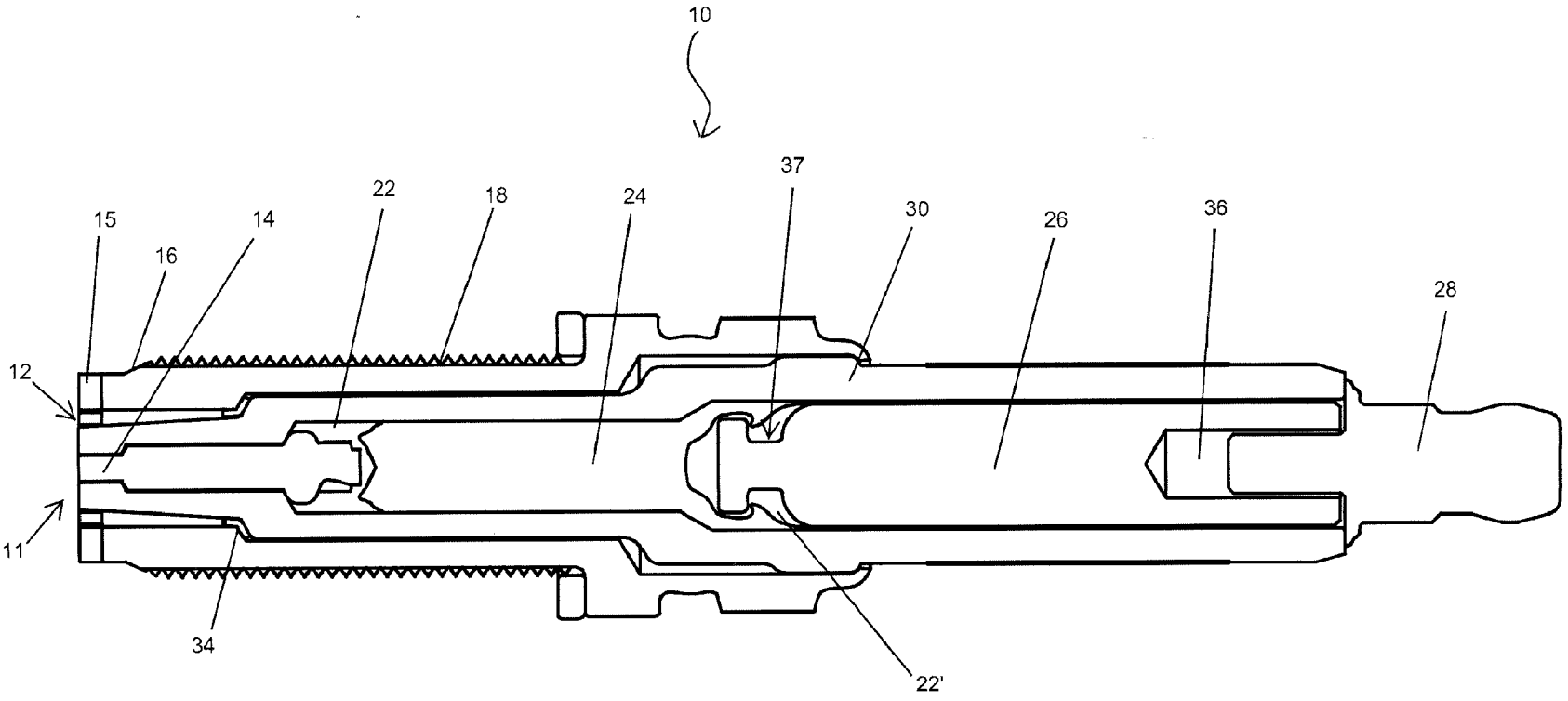
FIGS. 2A and B are drawings which illustrate cut-away views of alternative embodiments of a semi-surface gap spark plug of the present invention.
Figure 2B:
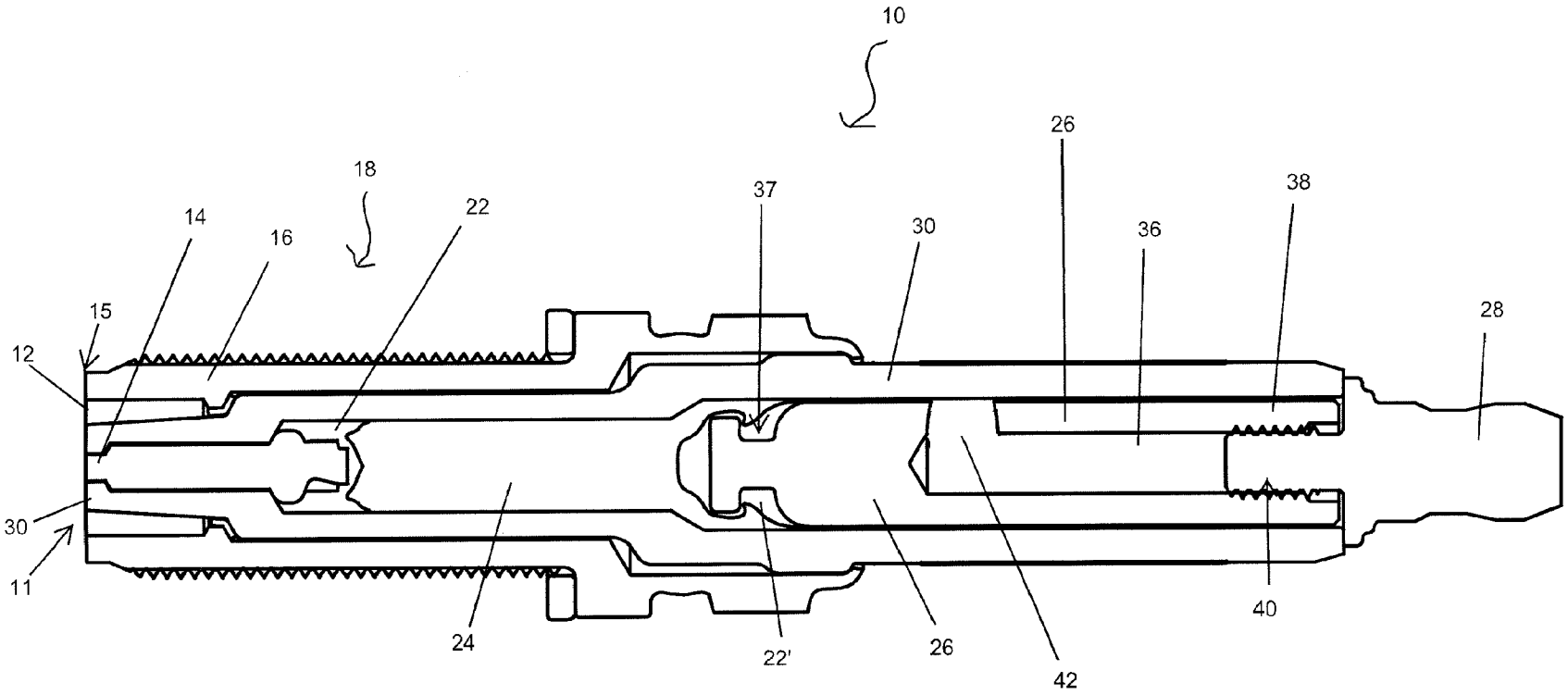

As best illustrated by comparing FIG. 2A with FIG. 2B, conductor 26 preferably comprises opening 36 at its terminal end. Optionally, opening 36 can comprise a smooth and/or friction-inducing surface into which an end portion of post 28 is press fit or otherwise electrically and mechanically connected. Optionally, opening 36 can have threads 38 formed therein such that post 28 can also be provided with threads 40, thus permitting post 28 to be screwed into opening 36 of conductor 26. In a further embodiment, opening 36 can extend only a short distance into conductor 26 so as to permit a portion of post 28 to engage therewith, or opening 36 can extend further than is necessary to accommodate a portion of post 28. In one embodiment, one or more additional openings 42 can be disposed at least substantially radially through a portion of conductor 26, most preferably in an arrangement which creates a communicable connection between opening 36 and opening 42, such that those openings intersect one another.

In one embodiment, conductor 26 preferably comprises recessed area 37 or another friction-creating configuration which permits connection material 22' and/or resistor 24 to lock onto conductor 26. In one embodiment, less than about 75%, and more preferably less than about 50% and most preferably less than about 25% of the inner plate of the capacitor is formed from a metallic substance. In one embodiment of the present invention the inner plate of the capacitor is formed from less than about 10% of a metallic substance. In one embodiment at least about 10% and more preferably at least about 50%, and most preferably at least about 75% of the inner plate of the capacitor is formed from a resistive material. In one embodiment, at least about 90% of the inner plate of the capacitor is formed from a resistive material.

Figure 3:
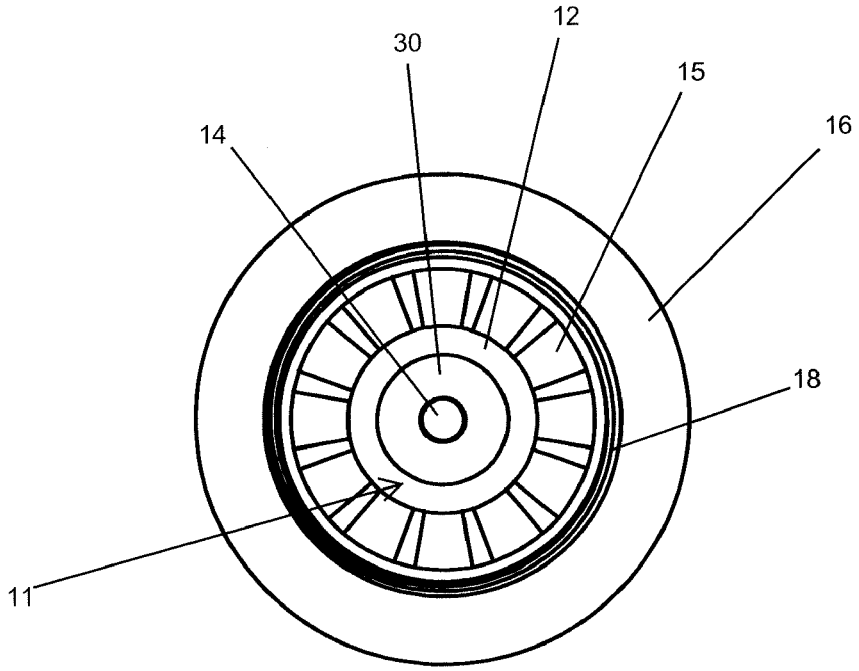
FIG. 3 is a drawing which illustrates an end-view of a crowned semi-surface gap spark plug according to an embodiment of the present invention.
Figure 4A:
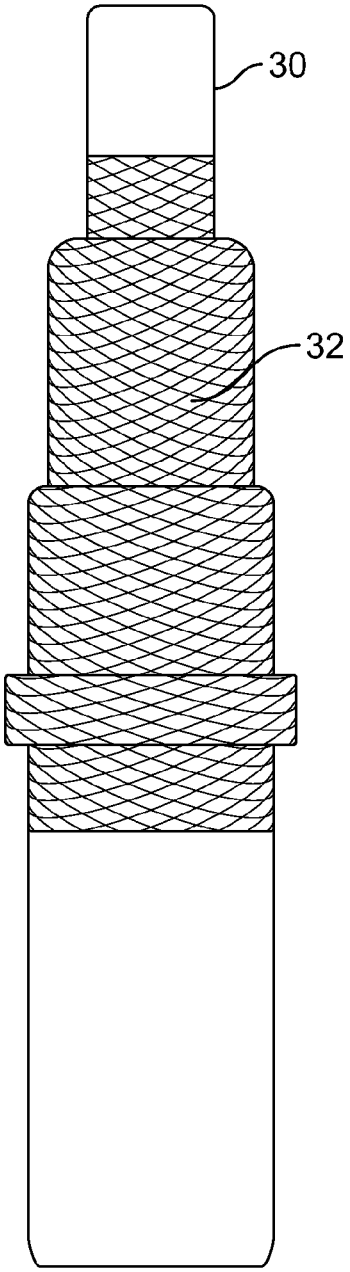
FIGS. 4A and 4B are drawings which respectively illustrate negative and positive conductive plates of a capacitor formed by application of a conductive ink or other conductive coating applied to an insulator of a spark plug according to an embodiment of the present invention.
Figure 4B:
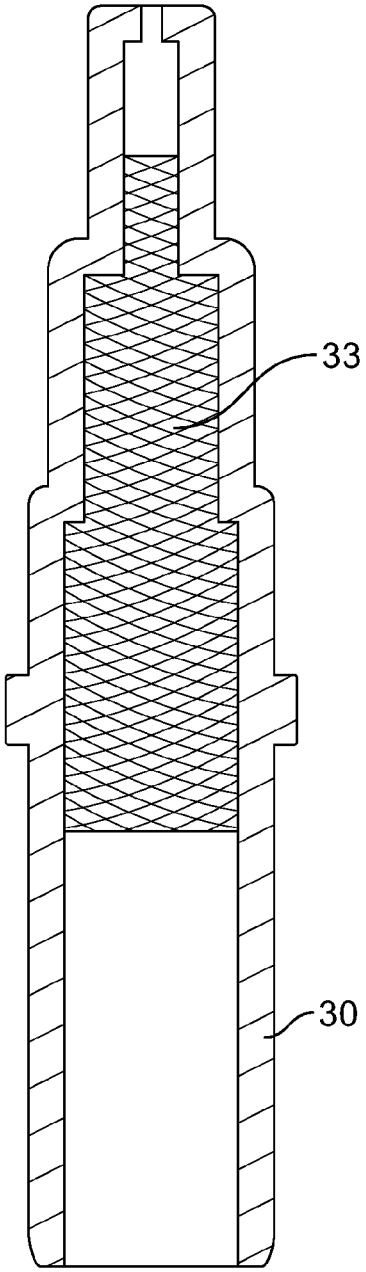

As best illustrated in FIG. 3, spark gap 11, which includes open air portion 12 and insulator end portion 30, is preferably concentrically formed around an end portion of inner conductor 14, such that a spark between inner conductor 14 and negative electrode 15 preferably extends radially there between, although it is preferably elongated axially via the Lorentz force. This is unlike the gap of a conventional spark plug wherein a spark extends only axially from an inner conductor. Optionally, negative electrode 15 can be formed from a portion of outer conductor 16 (see FIG. 2B). Optionally, however, negative electrode 15 can be formed from a material different and/or separate from outer conductor 16, including but not limited to tungsten, Schwartzkof, (PM 1000), nickel, platinum, iridium, rhenium, as well as combinations and alloys thereof. If negative electrode 15 is formed from a material separate from outer conductor 16, negative electrode 15 is most preferably electrically and mechanically connected to outer conductor 16, optionally via laser welding, friction welding, and mechanical fastener attachments, including but not limited to press-fit, male/female treads, combinations thereof and the like. Although desirable results can be obtained by providing an at least substantially concentric circularly-shaped negative electrode, negative electrode 15 can alternatively have a different shape, including but not limited to a crowned shape. Optionally inner conductor 14 and/or insulator 30 can be extended axially such that they project further away from negative electrode 15. Alternatively, negative electrode 15 can be extended axially such that it projects further away from inner conductor 14 and/or insulator 30. Optionally, a separate piece of material can be used to form the end portion of inner conductor 14, such as a high temperature metal and/or alloy. Optionally inner conductor 14 can have a different shape at its end than it has along its length, for example, inner conductor 14 can have a ball-shaped tip and/or a disc-shaped tip. In one embodiment, outer conductor 16 can taper toward the electrode end of the spark plug. Optionally, in one embodiment, outer conductor 16 can rest against insulator 30 at the electrode end of plug 10 such that open air portion 12 is not provided. Thus, although open air gap 12 is preferably provided, in one embodiment open air gap 12 is not provided. In this embodiment, an end surface of insulator 30 or another solid insulator surface preferably forms the entire gap between inner conductor 14 and negative electrode 15. In an alternative embodiment, insulator 30 does not extend all the way to the tip of inner conductor 14 and thus, the entirety of spark gap 11 is preferably formed by open air portion 12.

FIG. 7A is a cut-away perspective view drawing which illustrates a body portion 105 of an alternative embodiment of spark plug 10 according to an embodiment of the present invention. Optionally, any of the end configurations illustrated in FIGS. 7B-D can be disposed on an end portion of body portion 105 such that a plug having either a conventional J-shaped electrode (FIG. 7B), a crowned semi-surface gap electrode (FIG. 7C), or a non-crowned semi-surface gap electrode (FIG. 7D) can be formed into a spark plug according to an embodiment of the present invention. Still further, as best illustrated in FIG. 7E, a crowned semi-surface gap electrode can be provided which has only a small number of negative electrodes. Optionally, only 1 negative electrode can be provided. Alternatively, only two, three, four or five negative electrodes can be provided. In one embodiment, more than five negative electrodes can be provided. In one embodiment, one or more of the negative electrodes can have a non-uniform shape, wherein a terminal portion of the one or more negative electrodes is larger than a proximal portion of the one or more negative electrodes (See FIG. 10). As illustrated in FIG. 7A, body 105 preferably comprises insulator 30 as previously described, having conductive coating 32 (see FIG. 4A) applied to at least a portion of its outer surface as previously described. Conductive coating 32 preferably forms the negative plate of a capacitor. As best illustrated in the cut-away drawing of FIG. 4B, in one embodiment, positive plate 33 of the capacitor is formed from a conductive coating applied to at least a portion of the inner surface of insulator 30 along substantially the same length of insulator 30 as negative plate coating 32 was applied. Thus, insulator 30 preferably forms the dielectric of the capacitor. In one embodiment the conductive coatings that form, both the inner (positive) plate and the outer (negative) plate of the capacitor are preferably formed from a conductive ink. Optionally, none of resistive frit 132 is used to form a portion of the inner plate of the capacitor. Alternatively, however, all or a portion of resistive frit 132 can be used to form a portion of the inner plate of the capacitor. In one embodiment, first and second conducting frits 122 and 133 are preferably formed from a conductive frit material, which most preferably comprises a copper material, a silver material, an amalgam, or a combination thereof.

Gas seal insert 130 can be formed from a number of conductive materials. In one embodiment, gas seal insert 130 is most preferably formed from a steel material. Resistive frit 132 is most preferably sandwiched between first and second conductive frits 122 and 133. Thus, conductive frits 122 and 133 preferably help ensure electrical and mechanical connection between conductor 26, resistive frit 132, gas seal insert 130, and inner conductor 14. In this embodiment, all or a portion of the inner plate of the capacitor is formed from non-resistive material. Thus, the resistive material is able to provide a resistance in a circuit location such that it resists the flow of electricity which charges the capacitor, but does not resist the flow of electricity during a discharge cycle of the capacitor through spark gap 11. Preferably, the remaining portions of body portion 105 are consistent with the previously described embodiments of spark plug 10.

Figure 8A:
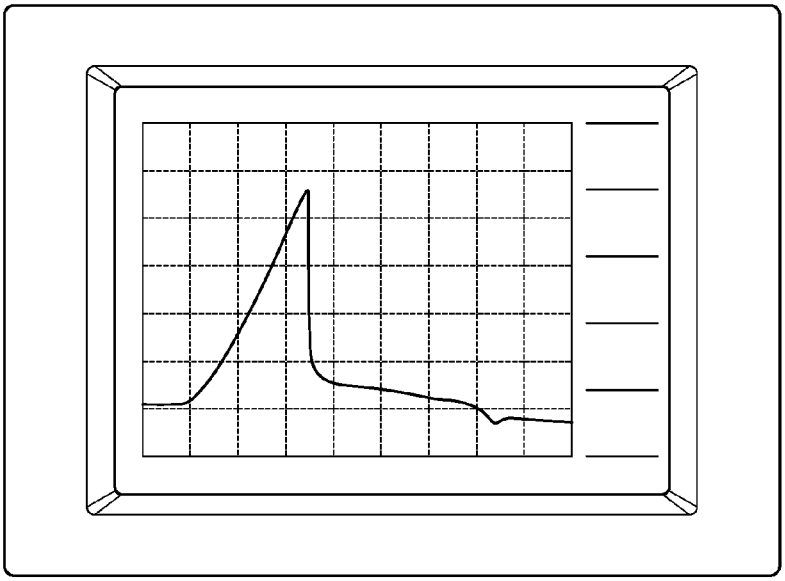
FIG. 8A (Prior Art)
FIGS. 8A-D are graphs which illustrate test results of a known spark plug (FIGS. 8A and B) and a spark plug according to an embodiment of the present invention (8C and D)
Figure 8B:
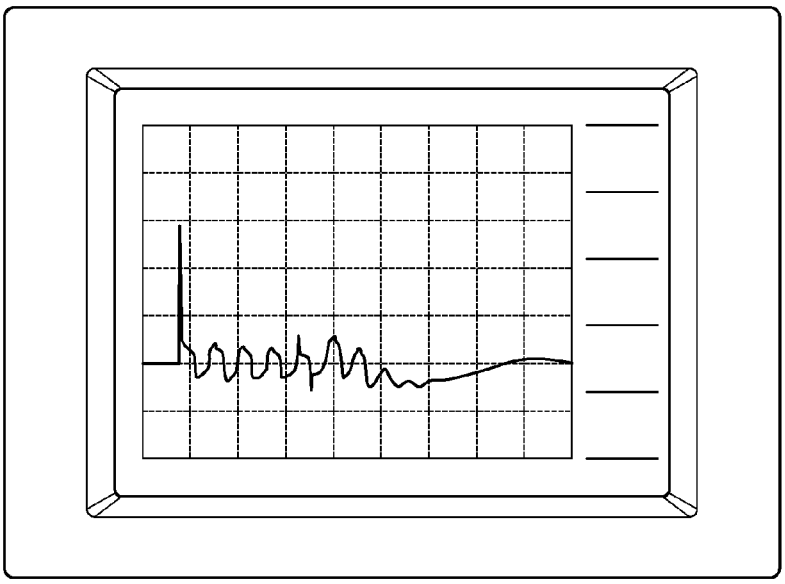
FIG. 8B (Prior Art)
Figure 8C:
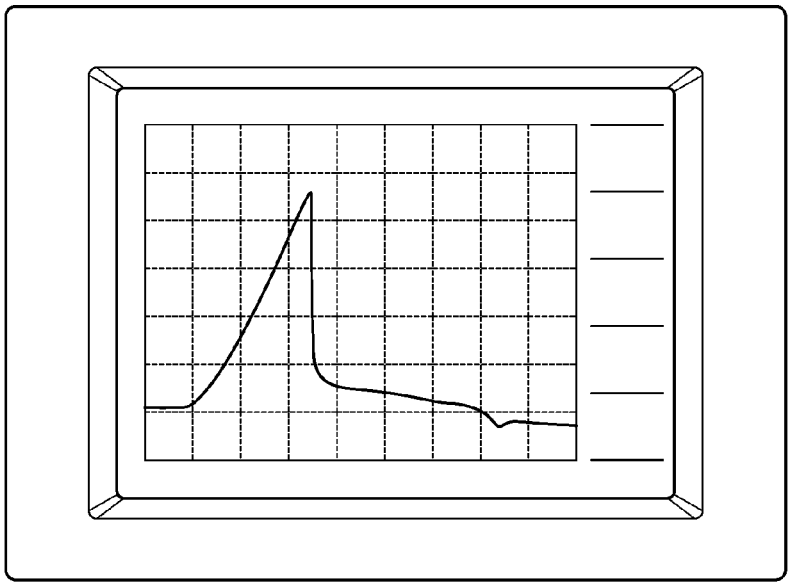
Figure 8D:
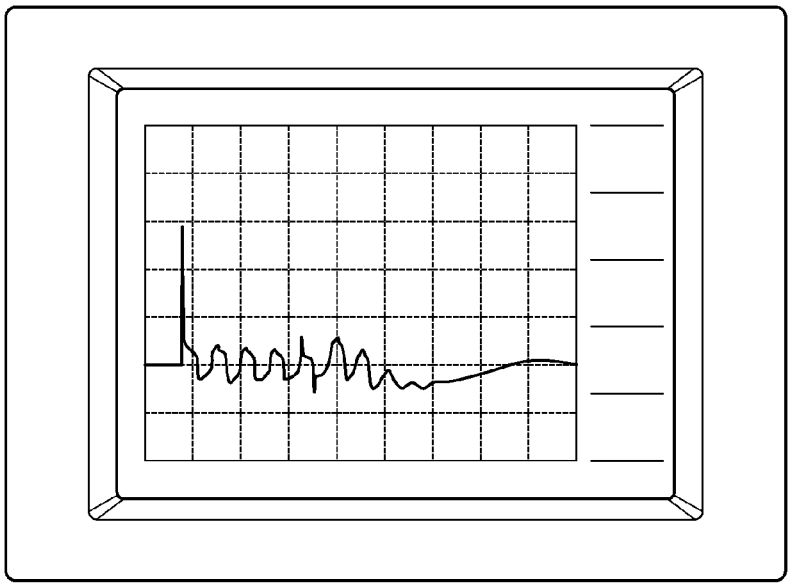
Figure 9:
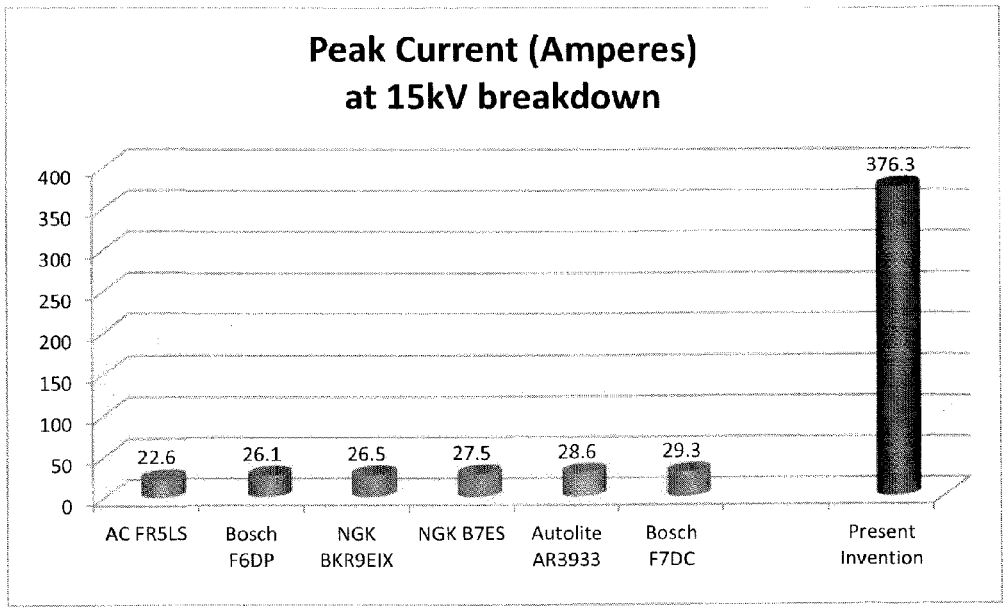
FIG. 9 is a graph which illustrates a comparison of peak currents provided by various known spark plugs and by a spark plug according to an embodiment of the present invention.

FIGS. 8A and B illustrate actual measurements obtained from a test using a prior art spark plug. FIGS. 8C and D illustrate actual measurements obtained from a spark plug constructed in accordance with the teachings of the present invention, under the same test conditions used in FIGS. 8A and B. As illustrated in each of FIGS. 8A-D, the Y axis of the graph illustrates spark-gap breakdown voltage and the X axis illustrates time. As can be seen, there is virtually no difference in the spark gap breakdown voltage nor in the total spark event time, thus proving that the capacitor in the plug constructed in accordance with the teachings of the present invention only effects the streamer phase of the spark in peaking the current of the discharge, as best illustrated in FIG. 9

Figure 5:
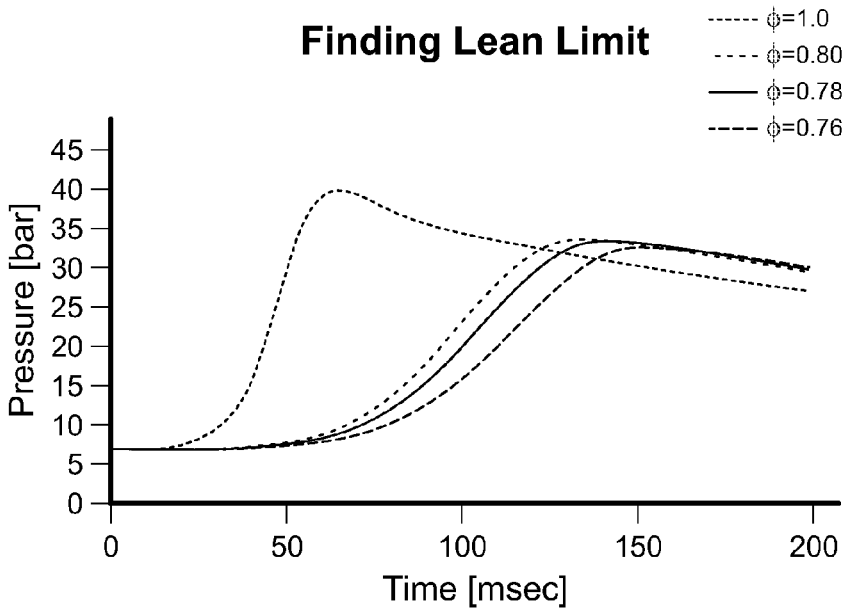
FIG. 5 (Prior Art)
FIGS. 5 and 6 respectively illustrate pressure graphs for a known spark plug and for a spark plug according to an embodiment of the present invention.
Figure 6:
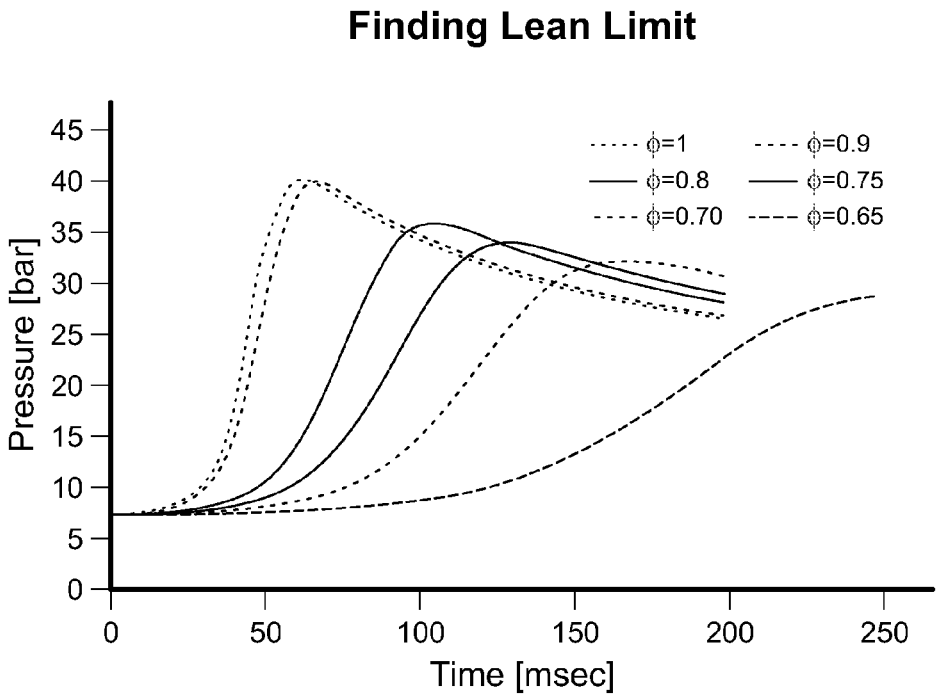

An embodiment of the present invention provides a capacitor on the high voltage side of an ignition system and not on the low voltage side of the ignition, wherein the low voltage side comprises voltages of less than about 1,000 volts and the high voltage side comprises voltages of greater than about 10,000 volts and more preferably greater than about 25,000 volts. In one embodiment, a spark plug according to an embodiment of the present invention is not used in conjunction with an ignition circuit having a capacitor. In one embodiment, when connected to a conventional engine circuit, plug 10 provides a spark having a peak power of at least 1 MW, and more preferably at least 4 MW, and most preferably about 5 MW. An embodiment of the present invention comprises providing a semi-surface gap shaped spark gap of a spark plug of a dynamic speed engine with an electrical spark having a power of at least 1,000 watts, more preferably at least 100,000 watts, even more preferably at least 1 M watts and most preferably about 5 M watts of peak power. In one embodiment, the spark plug of the present invention can be used in assisted homogeneous charged compression ignition systems. In one embodiment, the spark plug of the present invention can be used in forced semi-homogeneous charged compression ignition systems. The graphs of FIGS. 5 and 6 illustrate that high power plugs ignite and burn fuel better than conventional spark plugs. They produce shorter burn times and are capable of igniting much leaner mixtures, thus allowing the engine designer the ability to increase the EGR (exhaust gas recirculation) percentage in the fuel mixture to reduce emissions and increase fuel economy. The equivalence ratio of a system is defined as the ratio of the fuel-to-oxidizer in comparison to the stoichiometric fuel-to-oxidizer ratio—also called the "dilution". Where $\phi$ ("Phi")=1.00 the mixture is stoichiometric, a Phi=0.9 is a lean mixture.

Embodiments of the present invention are able to provide enhanced results in the use of semi-surface gap plugs such as to permit their adoption into applications which require dynamic engine speeds. This is because the enhanced spark provided by the capacitor that is formed in plug 10 not only produces a much more powerful spark, but also causes the spark to jump slightly away from plug 10 and thus project slightly further into the chamber into which plug 10 is placed. This combination of enhanced sparking power, the higher pressure wave created by the spark, and a slightly protruding spark results in a much more rapidly advancing explosion and thus a much quicker burn time. The quicker burn time results in significantly more turbulence than is encountered by conventional semi-surface gap spark plugs. This enhanced turbulence does two things. First, it causes the air/fuel mixture to more completely encompass the portion of the spark plug that projects into the engine cylinder, and the enhanced turbulence enables the spark gap of the plug to remain relatively free of deposits and buildups.

In one embodiment, the spark plug of the present invention can ignite non-stoichiometric air/fuel mixtures which are encountered in dynamic engine speed conditions. For the range of operation: Light load-low RPM to high load-high RPM and all of the other permutations, a pulsed plug having a conventional j-gap spark plug typically results in a breakdown voltage of from about 5 kV to about 25 kV. The higher the breakdown voltage, the greater the energy stored in the capacitor to discharge. Under the same operating conditions, the semi-surface gap requires about 20 kV to about 28 kV before breakdown. So, for all operating conditions, the semi-surface gap will be coupling more energy into the fuel charge. In a further embodiment, plug 10 projects less into a cylinder than a conventional J-gap plug. Thus, for rotary engines and very high compression racing engines, plug 10 projects less further into the cylinder and thus avoids piston head clearance problems. In one embodiment, a spark plug according to an embodiment of the present invention does not change the spark gap breakdown voltage. In one embodiment, a spark plug according to an embodiment of the present invention does not change and/or mitigate ignition timing. In one embodiment, a spark plug according to an embodiment of the present invention does not add an electrical load to the ignition system greater than a conventional sparkplug not having a semi-surface gap and not comprising a capacitor. In one embodiment, a spark plug according to an embodiment of the present invention does not change dwell or overall time of the spark event. Thus, spark plugs according to embodiments of the present invention can provide enhanced fuel efficiency and engine performance over a conventional plug and can be installed with no changes to engine calibration.

In one embodiment, particularly desirable results are obtained by the combination of a semi-surface plug and a high voltage pulse discharge. This is due to the effects on the electric spark that are caused by the Lorentz force. The magnitude of the Lorentz force exerted on the electrons forming the electrical arc is described by the equation: $F=q[E+(v*B)]$, where F is the Lorentz force, q is the particle's charge, E is the strength of the electric field, v is the velocity of the particle, and B is the magnitude of the magnetic field. As can clearly be seen by this equation, the high electric (E) and magnetic (B) fields created by the pulsed discharge work to greatly increase the Lorentz force exerted on the electrons that form the electric arc at the spark gap. Because the magnetic field that is created is a dependent on the magnitude of current flow, the Lorentz force exerted on the spark of a spark plug according to an embodiment of the present invention is further enhanced by the effect of the high current delivered during the discharge of the spark plug that is incorporated into the spark plug. In one embodiment, the spark is projected axially away from the end of the spark plug by the Lorentz force, one or more other forces, or a combination thereof.

Figure 10:
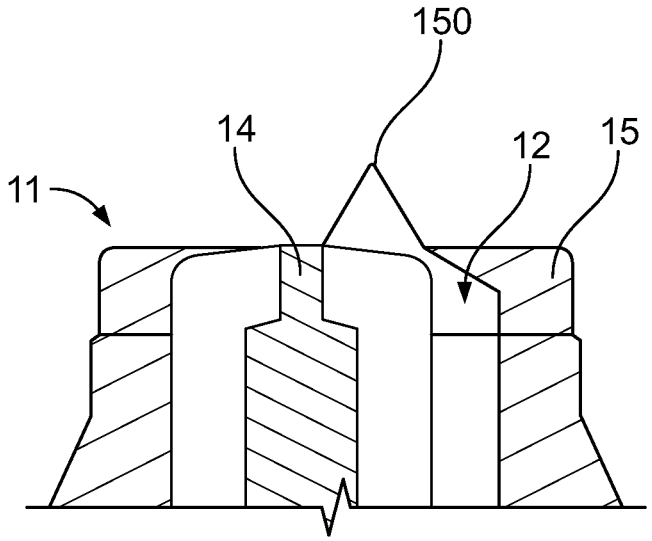
FIG. 10 is a drawing which illustrates the effect of the Lorentz force acting on the electric arc of a spark plug according to an embodiment of the present invention.

FIG. 10 is a drawing which illustrates the effect of the strong Lorentz force that is exerted on the electrons which form arc 150 on from plug 10. As can clearly be seen, the strong Lorentz force causes arc 150 to project axially away from the tip of the spark plug and further into the air/fuel mixture in the cylinder of the engine. This spark projection away from the tip of the spark plug and therefore more nearer the spatial center of the air/fuel mixture, causes the ensuing air/fuel ignition reaction wave to travel throughout the entire volume of the air/fuel mixture much more quickly. In addition, this creates a much larger flame kernel, thus resulting in a much quicker (0% to 50%) mass fractional burn of the combustion mixture. This results not only in providing a more-complete fuel burn with each ignition cycle, but also results in a higher piston pressure being developed more quickly, thus resulting in more engine torque and an increase in engine horsepower. In contrast, conventional spark gaps, wherein a side-wire is J-shaped requires that the side-wire project further into the combustion chamber. Because spark plugs are typically installed in engines at the same location that engine coolant is passed, a spark plug which projects into the fuel mixture thus acts as a heat sink. This results in the spark plug rapidly drawing heat away from the air/fuel mixture and thus impeding the reaction. The J-shaped side-wire also shrouds and further impedes the growing flame kernel. Therefore, such conventional-shaped spark gaps prevent a lean burn and reduce engine power and fuel economy.

An embodiment of the present invention does not require a capacitor separate from the spark plug in order to form a capacitor-discharge spark. In one embodiment, the spark gap is formed from a solid insulator portion disposed at least substantially concentrically around a positive electrode and an air gap portion at least substantially concentrically disposed around said solid insulator portion. In one embodiment, the central electrode does not extend axially throughout the plug. Rather, in this embodiment, the central electrode extends only partially into the electrode-end of the spark plug.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A spark plug comprising:

a central electrode;

a solid insulator at least substantially concentrically surrounding said central electrode at a terminal end portion thereof;

an air gap at least substantially concentrically surrounding said solid insulator at a terminal end portion thereof;

an outer electrode at least substantially concentrically surrounding said air gap;

wherein a spark gap is formed radially between said central electrode and said outer electrode and includes said air gap and a surface of said insulator such that a Lorentz force is exerted in an axial direction away from said spark plug; and a capacitor formed into said spark plug.

2. The spark plug of claim 1 wherein said outer electrode comprises one or more protuberances.

3. The spark plug of claim 1 wherein an outer plate of said capacitor is electrically connected to said outer electrode and wherein said solid insulator forms a dielectric of said capacitor.

4. The spark plug of claim 1 wherein said capacitor comprises two plates and wherein at least one of said plates is formed from a conductive ink.

5. The spark plug of claim 1 wherein said central electrode is electrically connected to a plate of said capacitor.

6. The spark plug of claim 1 wherein no portion of said outer electrode extends to intersect a path which is axially aligned with a primary axis of said center electrode.

7. The spark plug of claim 1 further comprising an electrical resistor communicably coupled to a plate of said capacitor.

8. The spark plug of claim 7 wherein said resistor is electrically connected such that it resists the flow of electricity during charging of said capacitor, but does not resist the flow of electricity from said capacitor to said spark gap.

9. A spark plug comprising:

a capacitor formed in said spark plug;

a spark gap formed on a terminal end portion of said spark plug such that a spark produced by said spark plug extends radially and such that a Lorentz force acting on the spark pushes it axially away from said terminal end portion of said spark plug;

said spark gap comprising a surface of a solid insulator and an air gap; and a terminal end portion of an outer conductor of said spark plug not projecting radially inward toward an inner conductor of said spark plug.

10. The spark plug of claim 9 wherein said terminal end portion of said a negative electrode comprises a plurality of protuberances disposed on a terminal end portion of said outer conductor.

11. The spark plug of claim 10 wherein said plurality of protuberances comprise at least 3 protuberances.

12. The spark plug of claim 9 wherein said plurality of protuberances comprise at least 5 protuberances.

13. The spark plug of claim 9 wherein a dielectric of said capacitor is formed from an insulator of said spark plug.

14. The spark plug of claim 13 wherein said dielectric, said insulator, and said solid insulator are all connected and are all formed from a single piece of material.

15. A method for igniting fuel comprising:

forming a capacitor into a spark plug;

forming a semi-surface spark gap such that sparks formed during operation of the spark plug extend radially between an inner conductor and an outer conductor and travel across a surface of a solid insulator and travel across an air gap; and projecting sparks formed during operation of the spark plug axially away from the spark plug due to the effects of a Lorentz force acting on the electron streams forming the sparks.

16. The method of claim 15 wherein projecting sparks comprises projecting sparks axially away from an end portion of the spark plug by a distance having a magnitude of at least ½ of a closest distance between the inner conductor and the outer conductor.

17. The method of claim 15 wherein projecting sparks comprises projecting sparks axially away from an end portion of the spark plug by a distance having a magnitude that is at least equal to that of a closest distance between the inner conductor and the outer conductor.

18. The method of claim 15 further comprising forming a dielectric of the capacitor from an insulator of the spark plug.

19. The method of claim 18 wherein the same piece of material forms the insulator of the spark plug, the dielectric of the spark plug, and the solid insulator that the spark travels across.

* * * * *